US009528698B2

(12) United States Patent
Cook et al.

(10) Patent No.: US 9,528,698 B2
(45) Date of Patent: Dec. 27, 2016

(54) BURNER

(76) Inventors: Richard D. Cook, North Ridgeville, OH (US); Michael J. O'Donnell, Avon, OH (US)

( * ) Notice: Subject to any disclaimer, the term of this patent is extended or adjusted under 35 U.S.C. 154(b) by 155 days.

(21) Appl. No.: 14/238,086

(22) PCT Filed: Aug. 10, 2012

(86) PCT No.: PCT/US2012/050278

§ 371 (c)(1),
(2), (4) Date: Feb. 10, 2014

(87) PCT Pub. No.: WO2013/023127

PCT Pub. Date: Feb. 14, 2013

(65) Prior Publication Data

US 2014/0186784 A1 Jul. 3, 2014

Related U.S. Application Data

(60) Provisional application No. 61/522,412, filed on Aug. 11, 2011, provisional application No. 61/602,261, filed on Feb. 23, 2012.

(51) Int. Cl.

| | |
|---|---|
| ***F23D 14/10*** | (2006.01) |
| ***F23D 14/58*** | (2006.01) |
| ***F23D 14/70*** | (2006.01) |
| ***F23D 14/02*** | (2006.01) |

(52) U.S. Cl.

CPC ..... *F23D 14/10* (2013.01); *F23D 14/02* (2013.01); *F23D 14/58* (2013.01); *F23D 14/70* (2013.01); *F23D 2203/102* (2013.01); *F23D 2203/1012* (2013.01); *F23D 2900/00003* (2013.01); *F23D 2900/14021* (2013.01)

(58) Field of Classification Search

CPC ..... F23D 14/58; F23D 14/70; F23D 14/02; F23D 14/10; F23D 2203/1012; F23D 2900/00003; F23D 2900/14021; F23D 2203/102

See application file for complete search history.

(56) References Cited

U.S. PATENT DOCUMENTS

| | | | |
|---|---|---|---|
| 2,704,440 | A | 3/1955 | Nicholson |
| 3,391,535 | A | 7/1968 | Benjamin |
| 5,984,670 | A | 11/1999 | McMillan et al. |
| 6,623,267 | B1 | 9/2003 | Golladay, Jr. |
| 2010/0104991 | A1 | 4/2010 | Okada et al. |
| 2010/0192873 | A1 | 8/2010 | Peart et al. |

OTHER PUBLICATIONS

PCT/US2012/050278 International Search Report & Written Opinion completed Oct. 18, 2012.

*Primary Examiner* — Alfred Basichas
(74) *Attorney, Agent, or Firm* — Tarolli, Sundheim, Covell & Tummino LLP

(57) ABSTRACT

A fuel burner includes an outer tube that extends along a central axis and has an outer surface and an inner surface defining a passage. An inner tube positioned within the passage of the outer tube has an outer surface and an inner surface defining a central passage. A fluid passage is defined between the outer surface of the inner tube and the inner surface of the outer tube. The fluid passage is supplied with a mixture of air and combustible

28 Claims, 6 Drawing Sheets

BURNER

CROSS REFERENCES TO RELATED APPLICATIONS

This application filed under 35 U.S.C §371 is a national phase application of International Application Ser. Number PCT/US2012/050278 filed Aug. 10, 2012, which claims priority to U.S. Provisional Application 61/522,412, filed. Aug. 11, 2011 and 61/602,261, filed Feb. 23, 2012.

TECHNICAL FIELD

The invention relates to a fuel burner and, in particular, relates to a fuel burner that imparts a centrifugal force upon combustion air or a combination of air and fuel.

BACKGROUND

Power burners of various types have been in use for many years. "Nozzle mix" or "gun style" burners are those burners that inject fuel and air separately in some manner so as to provide a stable flame without a ported flame holder component. Other types of power burners use some method of pre-mixing the fuel and air and then delivering the fuel-air mixture to a ported burner "head". These "heads" or "cans" can be made of a variety of materials including perforated sheet metal, woven metal wire, woven ceramic fiber, etc. Flame stability, also referred to as flame retention, is key to making a burner that has a broad operating range and is capable of running at high primary aeration levels. A broad operating range is desired for appliances that benefit from modulation, in which the heat output varies depending on demand. High levels of primary aeration are effective in reducing $NO_x$ emissions, but tend to negatively impact flame stability and potentially increase the production of Carbon Monoxide (CO). High levels of primary aeration (also referred to as excess air) also reduce appliance efficiency. There is a need in the art for a fuel burner that reduces the production of $NO_x$ while maintaining flame stability. Even more desirable is a burner that produces very low levels of $NO_x$ while operating at low levels of excess air.

SUMMARY OF THE INVENTION

In accordance with the present invention, a fuel burner includes an outer tube that extends along a central axis and has an outer surface and an inner surface defining a passage. An inner tube positioned within the passage of the outer tube has an outer surface and an inner surface defining a central passage. A fluid passage is defined between the outer surface of the inner tube and the inner surface of the outer tube. The fluid passage is supplied with a mixture of air and combustible fuel. The inner tube has fluid directing structure for directing the mixture from the fluid passage to the central passage such that the mixture rotates radially about the central axis.

In accordance with another aspect of the present invention, a fuel burner includes an outer tube that extends along a central axis and has a tapered portion for defining a passage. An inner tube is positioned within the passage of the outer tube and has an outer surface and an inner surface that defines a central passage. The inner tube extends from a first end to a second end. An end wall secured to the first end of the inner tube closes the first end of the inner tube in a gas-tight manner. A cap secures the second end of the inner tube to the outer tube in a gas-tight manner. A fluid passage is defined between the outer tube and the outer surface of the inner tube and is supplied with a mixture of air and combustible fuel. The inner tube has fluid directing structure for directing the mixture from the fluid passage to the central passage such that the mixture swirls about the central axis. The fluid directing structure provides the only fluid path between the fluid passage and the central passage.

Other objects and advantages and a fuller understanding of the invention will be had from the following detailed description of the preferred embodiments and the accompanying drawings.

BRIEF DESCRIPTION OF THE DRAWINGS

FIGS. 3A-4D are enlarged views of portions of alternative fluid directing structure in accordance with the present invention;

FIG. 4 is a schematic illustration of an air/fuel mixture traveling through the fuel burner of FIG. 1;

DETAILED DESCRIPTION

Figure 1:
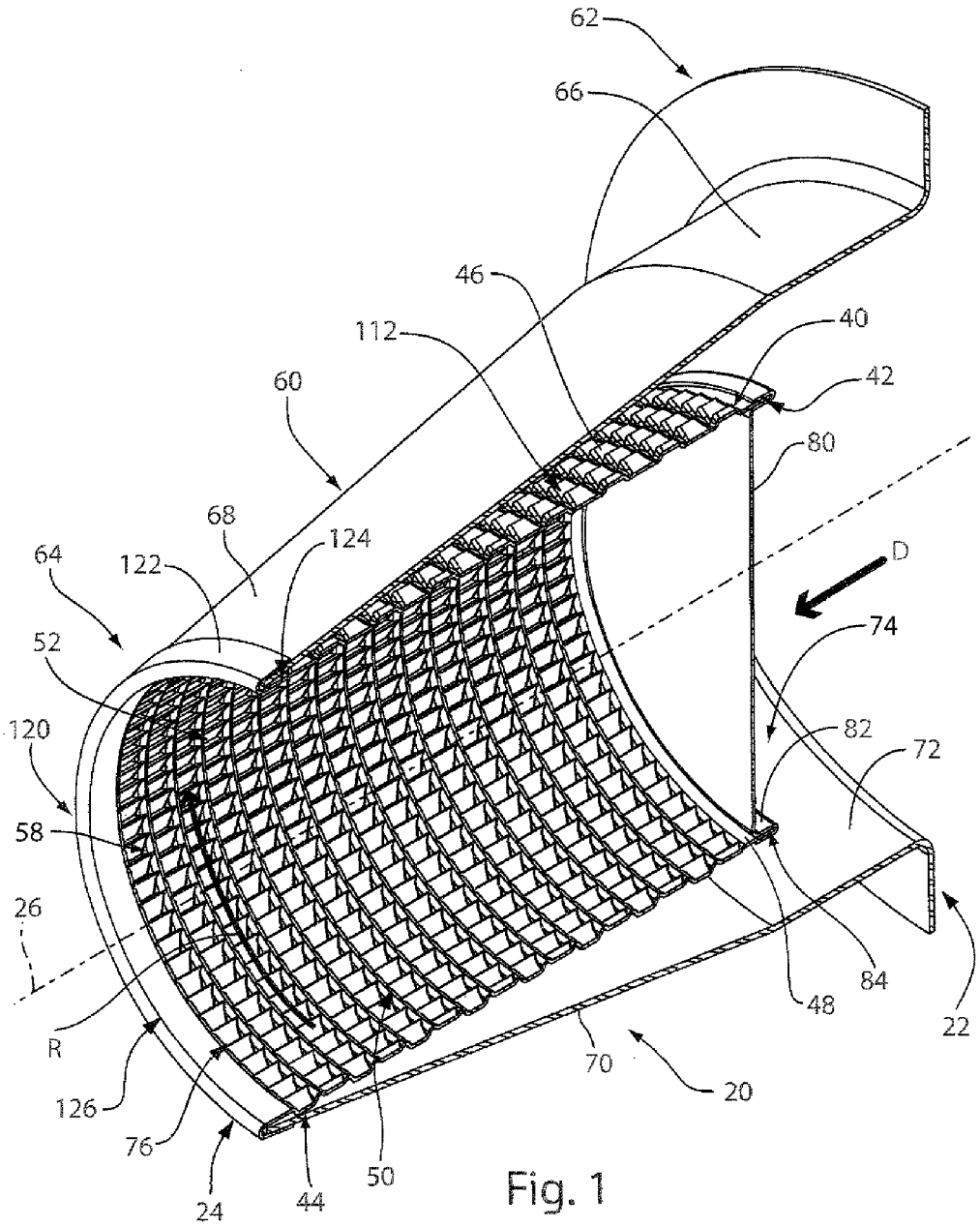
FIG. 1 is a schematic illustration of a fuel burner in accordance with the present invention.

The invention relates to a fuel burner and, in particular, relates to a fuel burner that imparts a centrifugal force upon combustion air or a combination of air and fuel. FIG. 1 illustrates a fuel burner 20 in accordance with an embodiment of the present invention. The fuel burner 20 may be used in industrial, household, and commercial appliances such as, for example, a water heater, boiler, furnace, etc.

The fuel burner 20 extends along a central axis 26 from a first end 22 to a second end 24. The fuel burner 20 includes a first, inner housing or tube 40 and a second, outer housing or tube 60. The inner tube 40 and the outer tube 60 are concentric with one another and are centered about the central axis 26. The inner tube 40 has a tubular shape and extends along the central axis 26 of the fuel burner 20 from a first end 42 to a second end 44. Although the inner tube 40 is illustrated as having a circular shape, it will be appreciated that the inner tube may exhibit alternative shapes, such as triangular, square, oval or any polygonal shape. The inner tube 40 includes an outer surface 46 and an inner surface 48 that defines a central passage 50 extending through the inner tube and terminating at an opening 58 at the second end 44 of the inner tube. The inner tube 40 is made from a durable, flame-resistant material, such as metal. The inner tube 40 has a constant cross-section as illustrated in FIG. 1. Alternatively, the inner tube 40 may have a cross-section that varies (not shown), e.g., is stepped, tapered, etc., along the central axis 26 of the fuel burner 20. In such a construction, the cross-section of the inner tube 40 may increase or decrease from the first end 42 to the second end 44 (not shown).

The space between the inner and outer tubes 40, 60 defines a fluid passage 112 for receiving fuel and air. The periphery of the inner tube 40 includes fluid directing structure 52 for directing fluid to the central passage 50. As shown in FIG. 1, the fluid directing structure 52 is configured to direct the air/fuel mixture to the central passage 50 in a direction that is offset from the central axis 26 of the fuel burner 20 and along a path that is angled relative to the normal of the inner surface 48 of the inner tube.

Figure 2A:
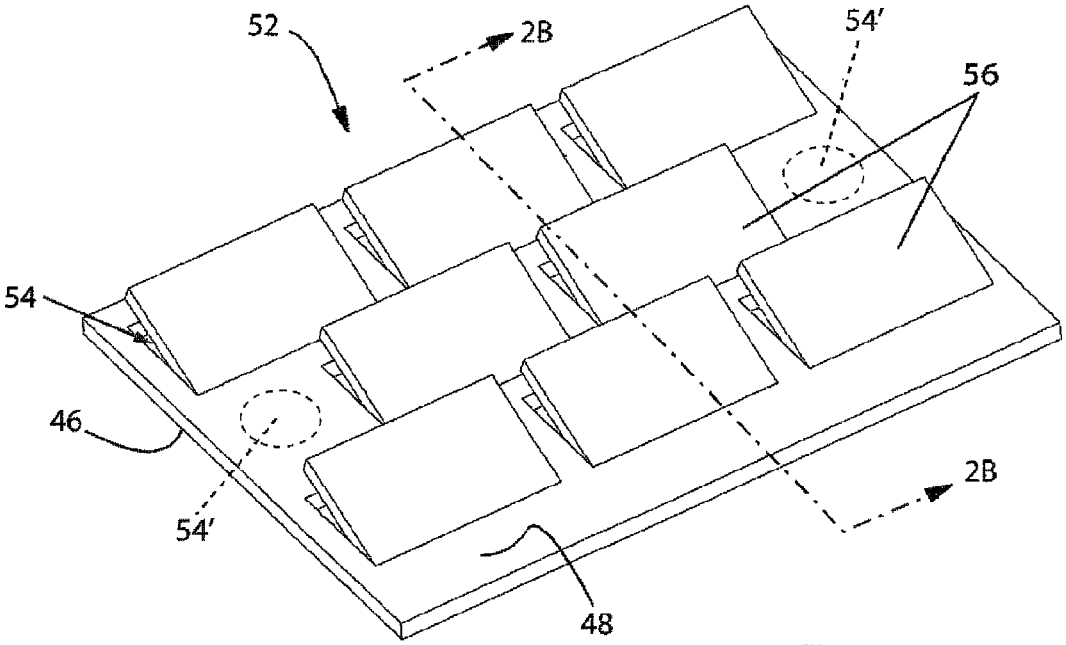
FIG. 2A is an enlarged view of a portion of a fluid directing structure constructed in accordance with a preferred embodiment of the invention.
Figure 2B:
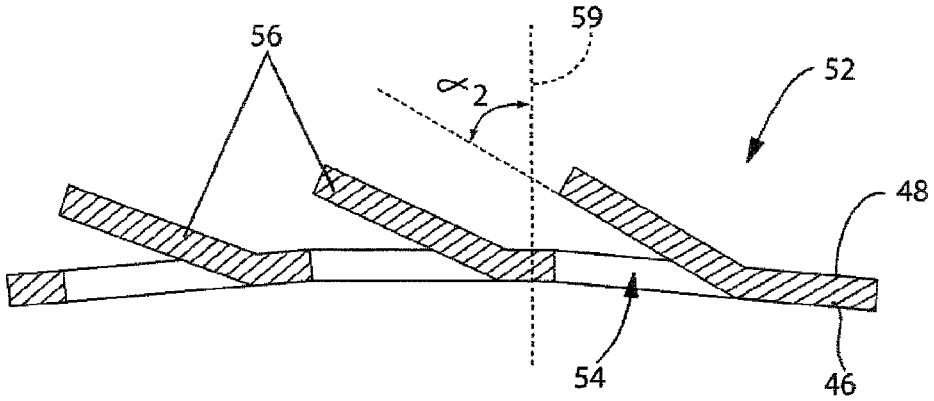
FIG. 2B is a section view of FIG. 2A taken along line 2B-2B.

The fluid direction structure 52 may include a series or openings with associated fins or guides for directing the fluid in the desired manner (FIGS. 2A-3D). As shown in FIGS. 2A-B, the fluid directing structure 52 includes a plurality of openings 54 in the inner tube 40 for allowing the air/fuel mixture to pass from the fluid passage 112 to the central passage 50 of the inner tube. Each of the openings 54 extends entirely through the inner tube 40 from the outer surface 46 to the inner surface 48. Each opening 54 may have any shape, such as rectangular, square, circular, triangular, etc. The openings 54 may all have the same shape or different shapes. The openings 54 are aligned with one another along the periphery, i.e., around the circumference, of the inner tube 40 to form an endless loop. One or more endless loops of openings 54 may be positioned adjacent to one another or spaced from one another along the length of the inner tube 40. Each loop may have any number of openings 54. The openings 54 in adjacent loops may be aligned with one another or may be offset from one another. The size, shape, configuration, and alignment of the openings 54 in the inner tube 40 is dictated by desired flow and performance characteristics of the air/fuel mixture flowing through the openings. Although the openings 54 are illustrated as being arranged in a predetermined pattern along the inner tube 40, it will be appreciated that the openings may be randomly positioned along the inner tube (not shown).

Each opening 54 includes a corresponding fluid directing projection or guide 56 for directing the air/fuel mixture passing through the associated opening radially inward into the central passage 50 in a direction that is offset from the central axis 26 of the fuel burner 20, i.e., a direction that will not intersect the central axis. The guides 56 are formed in or integrally attached to the inner tube 40. Each guide 56 extends at an angle (shown in FIG. 2B), relative to the outer surface 46 the inner tube 40. The guides 56 may extend at the same angle or at different angles relative to the outer surface 46 of the inner tube 40. Each guide 56 extends at an angle, indicated at $\alpha_2$, relative to an axis 59 extending normal to the inner surface 48 of the inner tube 40. Although the figures show all of the openings being designed to guide the air/fuel mixture in a direction that is offset from the central axis 26 of the burner, it should be noted that openings with other configurations may be used. For example, straight through openings, pointing at the central axis 26 (indicated in phantom by the reference character 54' in FIG. 2A) may be interspersed with guided openings 54 to achieve the same overall swirling effect.

FIGS. 3A-D illustrate alternative configurations of the fluid directing structure 52 in the inner tube 40 in accordance with the present invention. The fluid directing structure 52*a-d* directs the incoming air/fuel mixture radially inward toward the central passage 50 and in a direction that is 1) offset from the central axis 26 and 2) angled relative to the normal of the outer surface 46 of the inner tube 40 such that the air/fuel mixture exhibits a swirling, rotational path around the central axis while becoming radially layered relative to the central axis. The openings in the fluid directing structure may be randomly positioned along the inner tube 40 or may be arranged in any predetermined pattern dictated by desired flow and performance criterion.

Figure 3A:
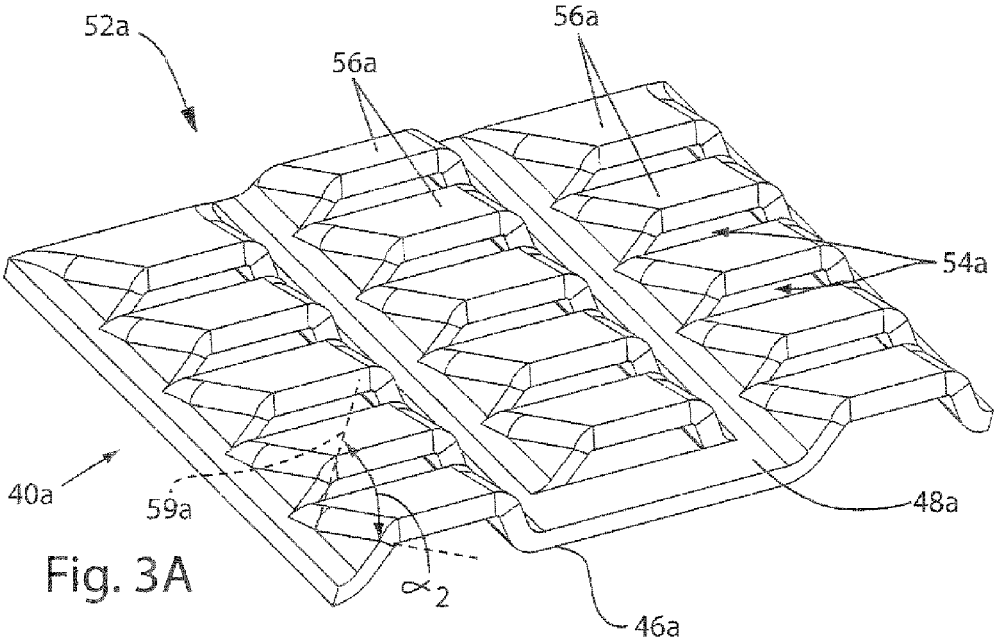

In FIG. 3A, the fluid directing structure 52*a* includes a plurality of guides 56*a* that define openings 54*a* in the inner tube 40*a*. The guides 56*a* are arranged in a series of rows that extend around the periphery of the inner tube 40*a*. The annular rows are positioned next to one another along the length of the inner tube 40*a*. The guides 56*a* of adjacent rows may be radially offset from one another or may be radially aligned with one another (not shown). The guides 56*a* in each row may be similar or dissimilar to one another. The guides 56*a* direct the air/fuel mixture passing through the openings 54*a* in a radially inward direction that is offset from the central axis 26 and at an angle $\alpha_2$ relative to the axis 59*a* extending normal to the outer surface 50*a* of the inner tube 40*a*. If the guides 56*a* within a row are fully or partially aligned with one another around the periphery of the inner tube 40*a*, the air/fuel mixture exiting each guide in that row is further guided in a direction offset from the central axis 26 by the rear side of the adjacent guide(s) in the same row.

Figure 3B:
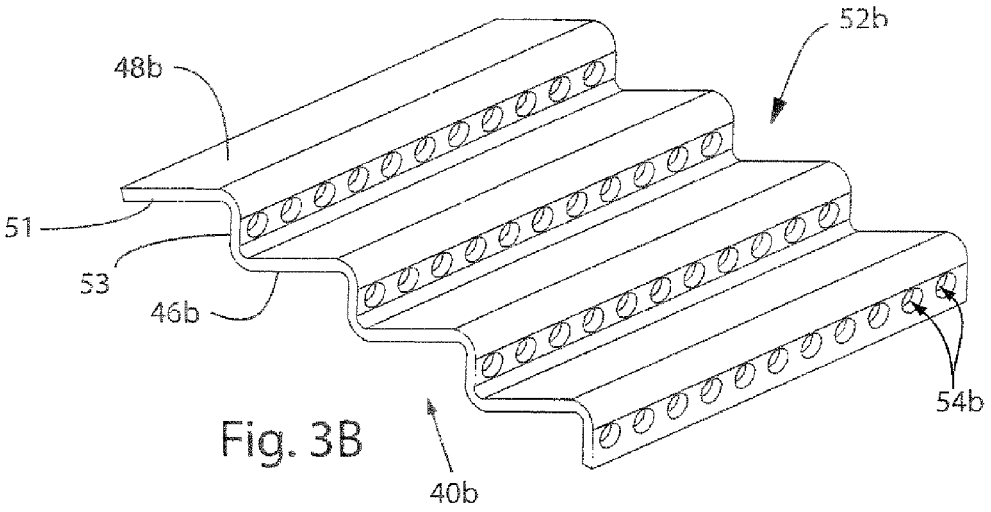

In FIG. 3B, the inner tube 40*b* is formed as a series of steps that each includes a first member 51 and a second member 53 that extends substantially perpendicular to the first member to form an L-shaped step. The second member 53 of each step includes a plurality of openings 54*b* for directing the air/fuel mixture in a direction that is offset from the central axis 26 and angled relative to the axis (not shown) extending normal to the outer surface 46*b* of the inner tube 40*b*. In particular, the openings 54*b* in each second member 53 direct the air/fuel mixture across the first member 51 of the adjoining step to impart rotation to the air/fuel mixture and, thus, to the air/fuel mixture within the central passage 50 about the central axis 26.

Figure 3C:
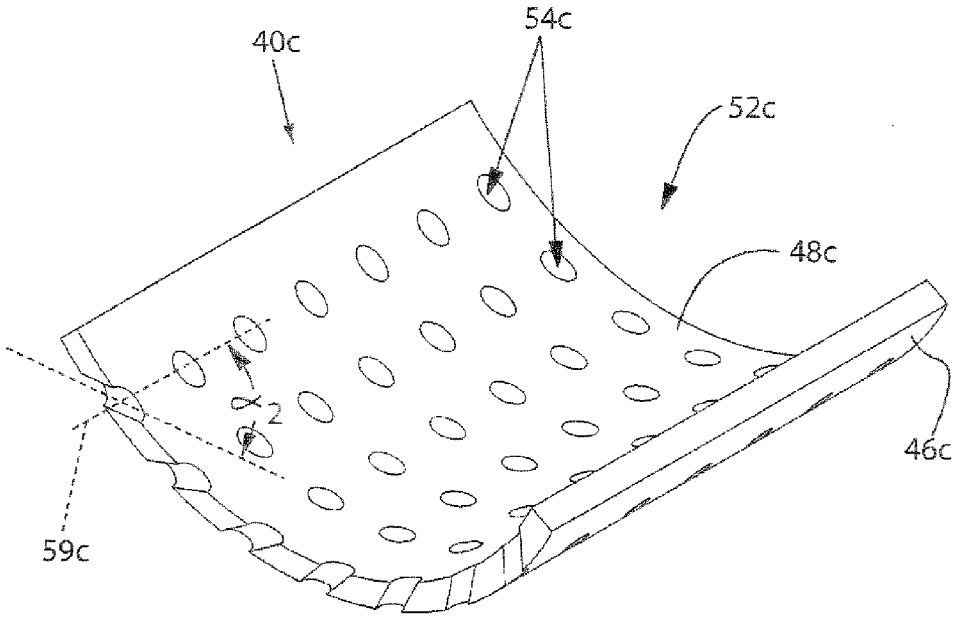

In FIG. 3C, the fluid directing structure 52*c* includes a plurality of openings 54*c* that extend from the outer surface 46*c* of the inner tube 40*c* to the inner surface 48*c*. The openings 54*c* extend through the inner tube 40*c* at an angle relative to the axis 59*c* extending normal to the outer surface 46*c* of the inner tube 40*c* and through the central axis 26 of the fuel burner 20. The openings 54*c* in the inner tube 40*c* direct the air/fuel mixture in a direction that is offset from the central axis 26 and at an angle relative to the axis 59*c* in order to impart rotation to the air/fuel mixture within the central passage 50 about the central axis.

Figure 3D:
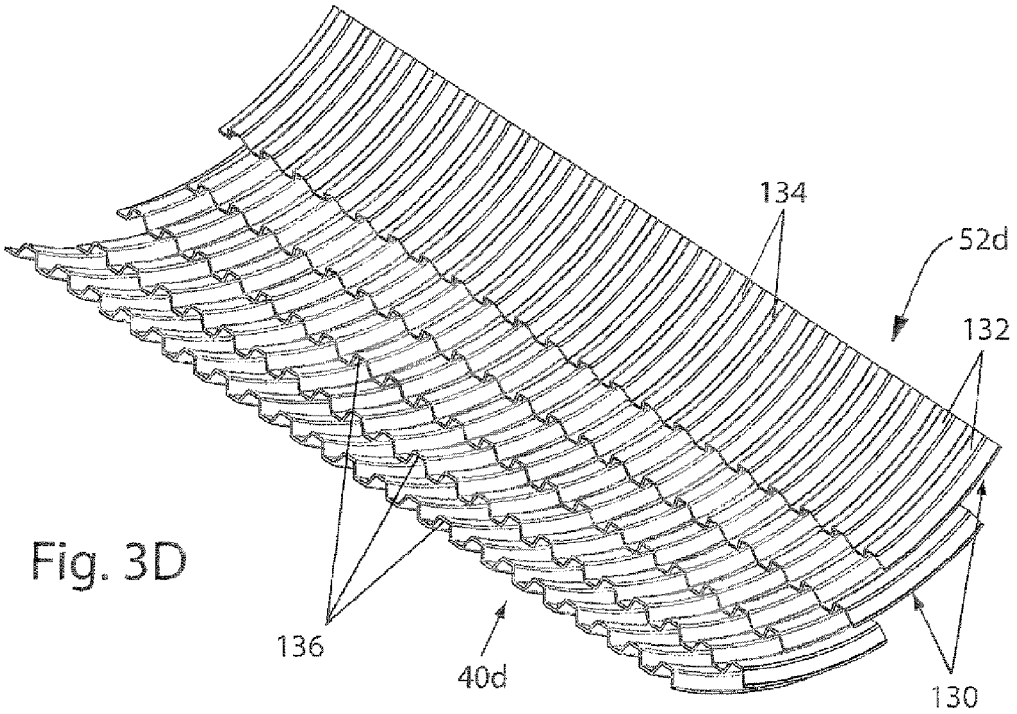
Figure 4:
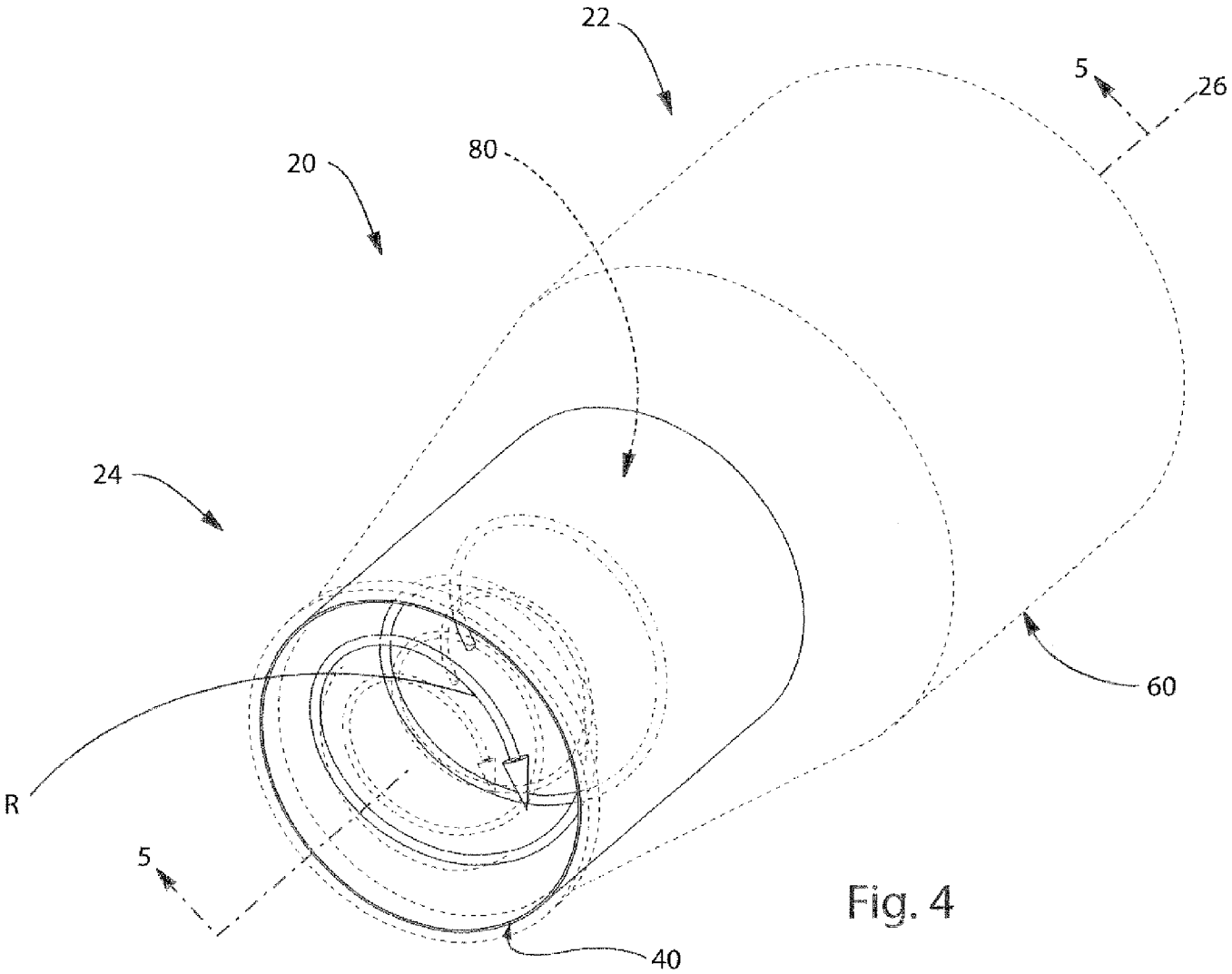

In FIG. 3D, the fluid directing structure 52*d* is formed by a series of arcuate, overlapping plates 130 that cooperate to form the inner tube 40*d*. Each plate 130 has a corrugated profile that includes peaks 132 and valleys 134. The plates 130 are longitudinally and radially offset from one another such that that peaks 132 of one plate 130 are spaced between the peaks of adjacent plates. In this configuration, the peaks 132 and valleys 134 of the plates create passages 136 through which the air/fuel mixture is directed. Each plate 130 directs the air/fuel mixture in a direction that extends substantially parallel to the adjoining arcuate plate to impart rotation to the air/fuel mixture and, thus, to the air/fuel mixture about the central axis 26. The air/fuel mixture within the central passage 50 is thereby directed in a direction that is offset from the central axis 26 of the fuel burner 20 and angled relative to the axis (not shown) extending normal to the plates 130.

As shown in FIG. 1, the outer tube 60 extends along the central axis 26 of the fuel burner 20 from a first end 62 to a second end 64. Although the outer tube 60 is shown as having a generally circular shape, it will be appreciated that the outer tube may exhibit any shape, which may be the same as or different from the shape of the inner tube 40. The outer tube 60 includes axially aligned first and second portions 66 and 68, respectively. The first portion 66 has a tubular shape and the second portion 68 has a frustoconical shape that tapers radially inward in a direction extending towards the second end 64 of the outer tube. It will be appreciated, however, that either or both the first portion 66 and the second portion 68 of the outer tube 60 may have a tapered or untapered shape (not shown). The outer tube 60 includes an outer surface 70 and an inner surface 72 that defines a passage 74 extending through the outer tube from the first end 62 of the outer tube to an opening 76 in the second end 64 of the outer tube.

A cap 120 is integrally formed with or secured to the inner tube 40 and seals and secures the inner tube to the outer tube 60. More specifically, the cap 120 is formed on the second end 44 of the inner tube 40 and is secured to the second end 64 of the outer tube 60 such that the inner tube extends into the passage 74 of the outer tube towards the first end 62 of the outer tube. The cap 120 has an annular shape and includes a wall 122 that exhibits a U-shaped configuration. The wall 122 defines a passage 124 for receiving the second end 64 of the outer tube 60. The wall 122 also defines a central opening 126 that is aligned with the opening 58 in the inner tube 40 and the opening 76 in the outer tube 60.

An end wall 80 is secured to the first end 42 of the inner tube 40 and closes the first end of the inner tube in a gas-tight manner. The end wall 80 includes an annular rim 82 that exhibits a U-shaped configuration. The rim 82 defines a passage 84 for receiving the first end 42 of the inner tube 40. The end wall 80 closes the first end 42 of the inner tube 40 to prevent the incoming fuel/air mixture from directly entering the central passage 50 of the inner tube.

When the fuel burner 20 is assembled (FIG. 1), the cap 120 securely connects the second end 44 of the inner tube 40 to the second end 64 of the outer tube 60 such that the inner tube extends within the passage 74 of the outer tube and along the central axis 26 of the fuel burner. In this configuration, the outer surface 46 of the inner tube 40 is positioned radially inward of the inner surface 72 of the outer tube 60 such that a portion of the passage 74 between the outer surface of the inner tube and the inner surface of the outer tube defines the fluid passage 112. The fluid passage 112 is in fluid communication with the fluid directing structure 52 in the inner tube 40 and, thus, is in fluid communication with the central passage 50 of the inner tube. In the illustrated embodiment, the inner tube 40 has a constant cross-section and the second portion 68 of the outer tube 60 has a frustoconical cross-section that tapers radially inward in a direction extending towards the second end 64 of the outer tube, consequently, the fluid passage likewise has a cross-section that tapers radially inward in a direction extending towards the second end of the outer tube. On the other hand, if the second portion 68 of the outer tube 60 is not tapered (not shown), the fluid passage 112 will have a constant cross-section along its length. Since the inner tube 40 may also have a stepped or tapered cross-section the resulting fluid passage 112 may have a cross-section that is stepped or tapered by configuring the fuel burner 20 in this alternative manner.

An ignition device (not shown) of any number of types well known in the art can be positioned in any number of suitable locations to light the fuel burner 20. For example, the end wall 80 may be provided with an opening (not shown) through which an igniter extends. Flame proving means (not shown) may be positioned in any number of suitable locations to detect the presence of flame. A supply of pre-mixed air and combustible fuel is delivered to the outer tube 60, which then flows into the passage 74 of the outer tube. Any number of pre-mixing systems which are well known in the art may be used in accordance with the present invention.

Figure 5:
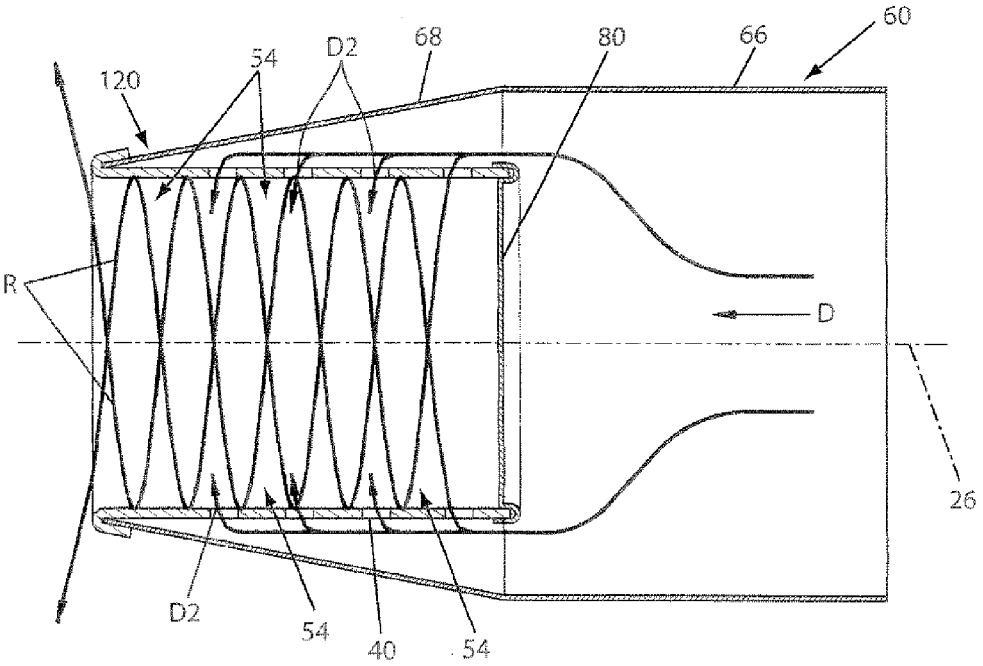
FIG. 5 is a section view of FIG. 4 taken along line 5-5.
Figure 6:
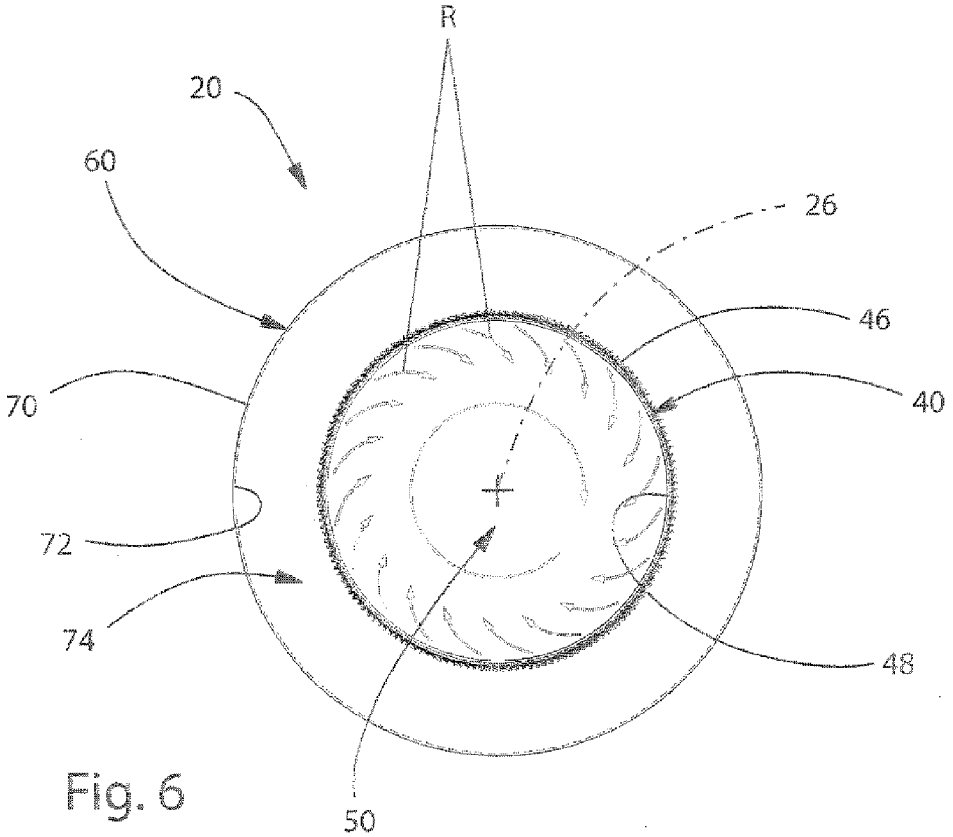
FIG. 6 is an end view of the fuel burner of FIG. 4.

In operation, the pre-mixing system (not shown) supplies a mixture of air and fuel to the fuel burner 20. In particular, the system pre-mixes the air and fuel and delivers the mixture as a stream to the passage 74 of the outer tube 60. The air/fuel mixture stream is delivered in the direction indicated by arrow D into the fluid passage 112 between the inner tube 40 and the outer tube 60. As shown in FIGS. 5-6, the air/fuel mixture continues to flow in the direction D towards the second end 24 of the fuel burner 20. The air/fuel mixture flows into the fluid passage 112 and radially inward through the fluid directing structure 52, as indicated generally at D2, in the inner tube 40 and towards the central passage 50. The gas-tight seal between the cap 120 and the outer tube 60 prevents the air/fuel mixture from exiting the fluid passage 112 in a manner other than through the openings 54 in the inner tube 40. The air/fuel mixture impacts the guides 56 and is deflected in a direction that is offset from the central axis 26 of the fuel burner 20 and angled relative to the axis 59 normal to the inner surface 48 of the inner tube 40. In particular, the guides 56 deflect the air/fuel mixture such that the air/fuel mixture is imparted with a centrifugal force that creates rotational dynamic forces within the central passage 50 of the inner tube 40.

Since the fluid directing structure 52, i.e., the openings 54 and guides 56, extend around the entire periphery of the inner tube 40 the air/fuel mixture within the central passage 50 is forced in a direction, indicated by arrow R (FIG. 1), that is transverse to the central axis 26 of the fuel burner 20. Consequently, the air/fuel mixture within the central passage 50 undergoes a rotational, spiraling effect relative to the central axis 26 of the fuel burner 20. Alternatively, the guides 56 may be configured to force the air/fuel mixture in a direction opposite to the arrow R (not shown).

The rotating, spiraling air/fuel mixture is ignited by an ignition device (not shown) of any number of types well known in the art and positioned in any number of suitable locations to light the fuel burner 20. For example, the wall 80 may be provided with an opening (not shown) through which an igniter extends. Flame proving means (not shown) may be positioned in any number of suitable locations to detect the presence of flame.

Due to the continued supply of air and fuel to the fuel burner 20 from the pre-mixing system, the air/fuel mixture streams become radially layered within the central passage 50. It is believed that the layering of air/fuel mixture streams within the central passage 50 increases the input flexibility of the burner assembly of the present invention. More specifically, it is believed that radially layering the air/fuel mixture streams allows the burner assembly of the present invention to operate effectively over a large range of air/fuel ratios and a large range of fuel input levels.

The burner assembly of the present invention is advantageous over conventional burners for several reasons. In conventional burners, the flame is propagated primarily by molecular conduction of heat and molecular diffusion of radicals from the flame into the approaching stream of reactants (fuel/air mixture). It is believed that the disclosed burner assembly forces additional paths of heat transfer by convection and radiation from the high velocity flame envelope overlaying and intermixing with the incoming fuel/air mixture. The incoming fuel/air mixture is pre-heated while the flame zone is being cooled, which advantageously helps to reduce $NO_x$. Radicals are also forced into the incoming reactant stream by the overlaying and intermixing flame envelope. The presence of radicals in a mixture of reactants lowers the ignition temperature and allows the fuel to burn at lower than normal temperature. It also helps to significantly increase flame speed, which shortens the reaction time, thereby additionally reducing $NO_x$ formation while significantly improving flame stability/flame retention. Typical combustors achieve flame retention/stability by incorporating a region where reactants' flow is low in order to anchor the flame, such as edges of ports, bluff bodies, mesh surfaces, small "flame holder" ports of low velocity surrounding larger ports, and many others. Different types of "swirl" burners have also been developed over the years. These types of combustors create recirculation regions of low velocities for anchoring the flame.

Due to the exceptional flame retention/stability of the burner of the present invention, it is capable of running at very high port loadings. High port loadings allow the burner of the present invention to run in a stable "lifted flame" mode, i.e., the flame is spaced from the inner surface 48 of the inner tube. Lifting of the flame in this manner is desirable in that the inner tube 40 is not directly heated, thereby maintaining the inner tube at a lower temperature and lengthening the usable life of the fuel burner 20. A high port loading also allows the use of a smaller, space saving and less costly burner for a given application.

Furthermore, $NO_x$ production in the burner assembly of the present invention is significantly lower than in other burner systems, confirming a lower flame temperature and reduced reaction time. Low CO confirms a longer dwell time of combustion gases in the reaction zone (swirling inside of the burner head). More specifically, typical pre-mixed ported or mesh covered burners will run total $NO_x$ of about 10 ppm at about 8% $CO_2$ (or less) when burning natural gas, depending somewhat on the application. On the other hand, the disclosed burner of the present invention has achieved 10 ppm of total $NO_x$ at 10% $CO_2$. Anyone skilled in the art of appliance design and heat transfer will recognize the significant increase in appliance efficiency when running at 10% $CO_2$ compared with the same appliance operating at 8% $CO_2$. The disclosed burner, due to the exceptional flame retention as discussed above, is also capable of operating cleanly, i.e., low CO, at very high levels of excess air, which produces $NO_x$ levels well below those achievable with conventional burners.

The preferred embodiments of the invention have been illustrated and described in detail. However, the present invention is not to be considered limited to the precise construction disclosed. Various adaptations, modifications and uses of the invention may occur to those skilled in the art to which the invention relates and the intention is to cover hereby all such adaptations, modifications, and uses which fall within the spirit or scope of the appended claims.

Having described the invention, the following is claimed:

1. A fuel burner comprising:

an outer tube extending along a central axis and having an outer surface and an inner surface defining a passage; and an inner tube positioned within the passage of the outer tube and having an outer surface and an inner surface defining a central passage, wherein a fluid passage is defined between the outer surface of the inner tube and the inner surface of the outer tube, the fluid passage being supplied with a mixture of air and combustible fuel premixed upstream of the fluid passage, the inner tube having fluid directing structure for directing the premixed mixture from the fluid passage to the central passage such that the mixture rotates radially about the central axis.

2. The fuel burner of claim 1, wherein the outer tube includes a tapered portion such that the fluid passage tapers in a direction extending parallel to the central axis.

3. The fuel burner of claim 1, wherein the fluid directing structure includes a plurality of openings and a guide associated with each opening that extends from the inner surface into the central passage, the guides being angled relative to the inner surface for radially rotating the premixed mixture about the central axis.

4. The fuel burner of claim 3, wherein the guides are arranged in a series of rows that extend continuously around the periphery of the inner tube to encircle the central axis of the outer tube.

5. The fuel burner of claim 1, wherein the fluid directing structure directs the premixed mixture in a direction that is offset from the central axis.

6. The fuel burner of claim 1 further comprising a fluid directing wall positioned within the passage of the outer tube, the fluid directing wall including an opening for receiving the igniter.

7. The fuel burner of claim 1, wherein the fluid directing structure includes a series of steps formed into the inner tube, the steps including openings for directing the premixed mixture into the central passage to rotate the mixture radially about the central axis.

8. The fuel burner of claim 7, wherein each step has an L-shaped including a first member and a second member including the openings for directing the premixed mixture such that the openings of one step direct the mixture across the adjoining step to impart rotation to the mixture.

9. The fuel burner of claim 1, wherein the fluid directing structure includes a plurality of openings that each extend from the outer surface of the inner tube to the inner surface, each opening extending through the inner tube at an angle relative to an axis extending normal to the outer surface of the inner tube and through the central axis.

10. The fuel burner of claim 9, wherein the inner tube includes a plurality of second openings that each extend from the outer surface of the inner tube to the inner surface in a direction extending perpendicular to the central axis.

11. The fuel burner of claim 1, wherein the inner tube is formed as a series of overlapping arcuate plates that define the fluid directing structure, each plate having a corrugated profile having a series of passages through which the premixed mixture is directed into the central passage.

12. The fuel burner of claim 11, wherein the corrugated profile includes a plurality of alternating peaks and valleys.

13. The fuel burner of claim 12, wherein the overlapping plates are longitudinally and radially offset from one another such that the peaks of one plate are positioned between the peaks of adjacent plates.

14. The fuel burner of claim 11, wherein each plate directs the premixed mixture in a direction that extends substantially parallel to the adjoining plate to impart rotation to the mixture.

15. The fuel burner of claim 1, wherein the outer tube includes a first portion with a tubular shape and a second portion with a frustoconical shape.

16. The fuel burner of claim 1, wherein the inner tube includes a first end and a second end, an end wall being secured to the first end for closing the first end of the inner tube in a gas-tight manner, a cap securing the second end of the inner tube to the outer tube in a gas-tight manner such that the fluid directing structure provides the only fluid path from the fluid passage and the central passage.

17. The fuel burner of claim 16 further comprising an igniter that extends through the end wall for igniting the mixture.

18. The fuel burner of claim 17 further comprising flame proving means for detecting the presence of a flame within the central passage in a direction extending from the inner surface of the inner tube to the central axis.

19. The fuel burner of claim 1, wherein the premixed mixture is radially layered within the central passage.

20. The fuel burner of claim 1, wherein the fuel burner produces about 10 ppm of total $NO_x$ at about 10% $CO_2$.

21. The fuel burner of claim 1, wherein the mixture is premixed upstream of the inner tube.

22. The fuel burner of claim 1, wherein the premixed mixture enters the fluid passage in a direction extending parallel to the central axis of the outer tube.

23. The fuel burner of claim 1, wherein the fluid directing structure encircles the central axis of the outer tube.

24. The fuel burner of claim 1, wherein the fluid directing structure extends around the entire periphery of the inner tube such that a flame envelope overlies and intermixes with the premixed mixture entering the central passage.

25. The fuel burner of claim 24, wherein the flame envelope is spaced entirely from the inner surface of the inner tube.

26. A fuel burner comprising:

an outer tube extending along a central axis and having a tapered portion for defining a passage;

an inner tube positioned within the passage of the outer tube and having an outer surface and an inner surface defining a central passage, the inner tube extending from a first end to a second end;

an end wall secured to the first end of the inner tube and closing the first end of the inner tube in a gas-tight manner;

a cap securing the second end of the inner tube to the outer tube in a gas-tight manner; and a fluid passage defined between the outer tube and the outer surface of the inner tube, the fluid passage being supplied with a mixture of air and combustible fuel premixed upstream of the fluid passage, the inner tube having fluid directing structure for directing the mixture from the fluid passage to the central passage such that the mixture swirls about the central axis, the fluid directing structure providing the only fluid path between the fluid passage and the central passage.

27. The fuel burner of claim 26, wherein the mixture is premixed upstream of the inner tube.

28. The fuel burner of claim 26, wherein the premixed mixture enters the fluid passage in a direction extending parallel to the central axis of the outer tube.

* * * * *